United States Patent [19]

Morin

[11] 4,101,163

[45] Jul. 18, 1978

[54] COLLAPSIBLE CHAIR

[76] Inventor: Robert J. Morin, 4720 Preda Dr., Pontiac, Mich. 48054

[21] Appl. No.: 769,239

[22] Filed: Feb. 16, 1977

[51] Int. Cl.[2] ..... A45D 29/04

[52] U.S. Cl. ..... 297/16; 297/4; 248/155.5

[58] Field of Search ..... 297/4, 34, 16, 51; 298/155, 155.4, 155.5

[56] References Cited

U.S. PATENT DOCUMENTS

| | | | |
|---|---|---|---|
| 671,638 | 4/1901 | Slagle | 297/4 |
| 699,932 | 5/1902 | Smith | 297/4 |
| 1,417,250 | 5/1922 | Kelly | 297/4 |
| 3,310,340 | 3/1967 | Brewer et al. | 297/16 |
| 3,912,209 | 10/1975 | Turpin | 248/155.5 X |

FOREIGN PATENT DOCUMENTS

| | | | |
|---|---|---|---|
| 15,615 | 6/1929 | Australia | 297/4 |
| 343,087 | 12/1959 | Switzerland | 297/4 |
| 762 | 1/1898 | United Kingdom | 297/4 |

*Primary Examiner*—Roy D. Frazier
*Assistant Examiner*—Peter A. Aschenbrenner
*Attorney, Agent, or Firm*—Basile and Weintraub

[57] ABSTRACT

A collapsible chair adapted to be carried by a user wherein the chair comprises a seat which is pivotally attached to a support post which, in turn, is pivotally attached to a disk-shaped base such that the seat and base may be pivoted with respect to the post from an open, usable position to a collapsed position. The post includes a first threaded member rotatably received within a threaded bore of a second member such that the height of the seat may be adjusted with respect to the base as well as permit the user, while seated on the chair, to rotate with respect to the base. Locking pins are provided to facilitate the secure engagement of the seat and base, respectively, with the opposite ends of the support post during use and when the chair is in a collapsed position.

1 Claim, 4 Drawing Figures

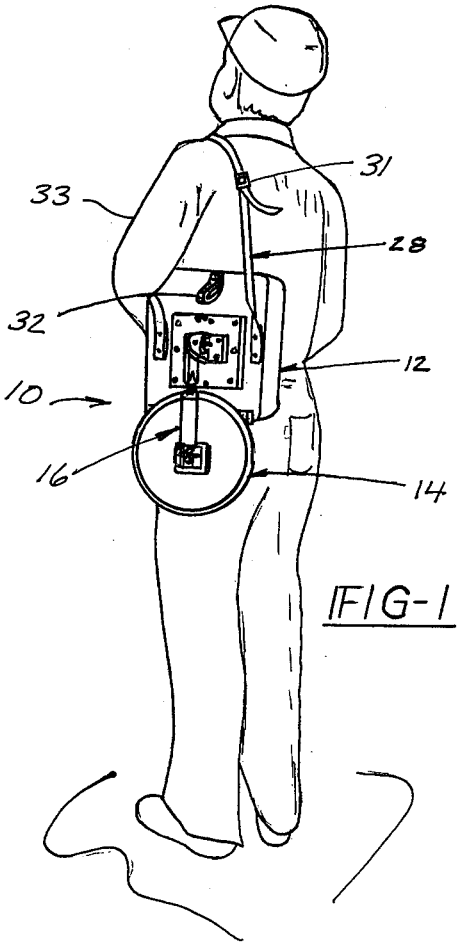
FIG-1
FIG-2
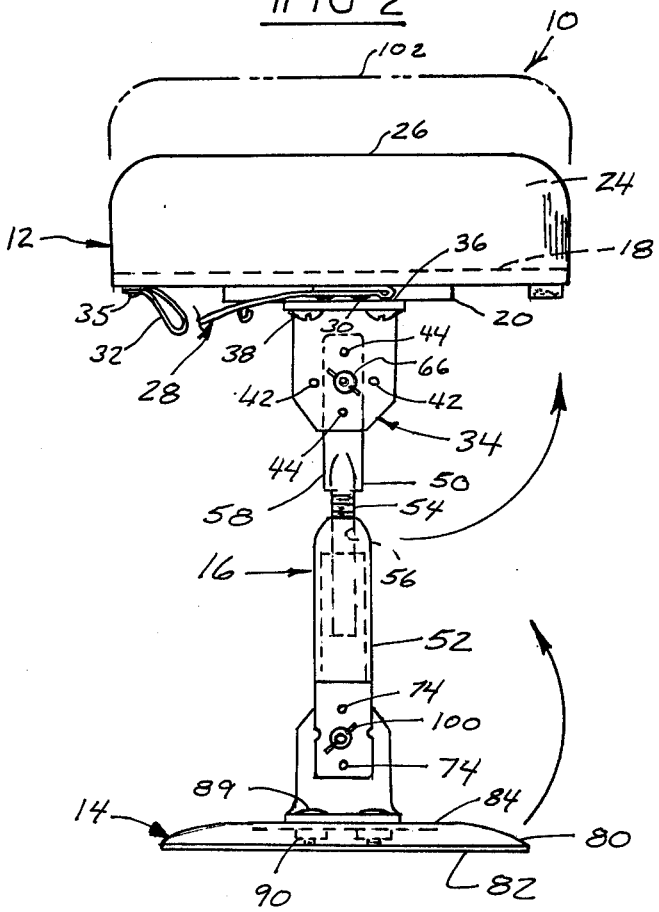
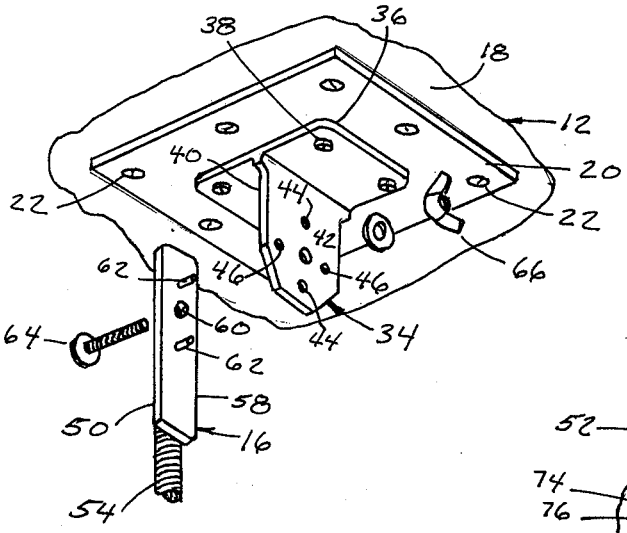
FIG-3
FIG-4
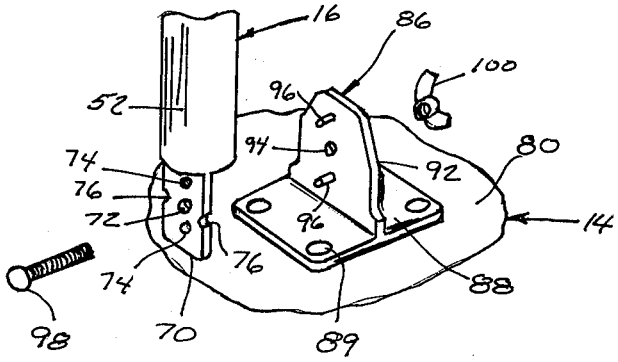

COLLAPSIBLE CHAIR

BACKGROUND OF THE INVENTION

I. Field of the Invention

The present invention relates generally to collapsible chairs and, in particular, to a collapsible chair adapted to be carried by a user.

II. Description of the Prior Art

Although collapsible seating devices and chairs designed for use by campers, hunters, sportsmen, and other outdoor recreational users may be commercially available, it has been found that they are too bulky and clumsy to carry in many situations encountered by the user. Various collapsible and portable seat constructions have been suggested as a means for overcoming the aforementioned disadvantage of collapsible chairs. Examples of such collapsible chairs are disclosed in U.S. Pat. Nos. 699,932; 3,310,340; and 3,985,387. While each of these patents broadly discloses collapsible chairs which attempt to provide a portable chair that is conveniently usable, they do present disadvantages which applicant believes are overcome by his unique design.

SUMMARY OF THE INVENTION

The present invention, which will be described subsequently in greater detail, comprises a collapsible chair adapted to be carried by the user. The chair comprises a disk-shaped base pivotally and releasably attachable to the lower end of a support post, while a seat is pivotally and releasably attached to the other end of the support post. An intermediate portion of the support post is rotatably and telescopically connected to permit the seat to be raised and lowered with respect to the base, while simultaneously providing the user with a means for rotating his position with respect to the base, while the user is seated on the chair.

It is therefore an object of the present invention to provide a new and improved collapsible chair which is relatively simple in design, of light-weight construction, and which is designed to be conveniently carried by the user.

It is a further object of the present invention to provide a collapsible chair which serves as a safe and practical seat for use by hunters and the like and for other persons who desire a comfortable support and a temporary rest for whatever the occasion or purpose may be.

Other objects, advantages and applications of the present invention will become apparent to those skilled in the art of collapsible chairs when the accompanying description of one example of the best mode for practicing the invention is read in conjunction with the accompanying drawing.

BRIEF DESCRIPTION OF THE DRAWING

The description herein makes reference to the accompanying drawing wherein like reference numerals refer to like parts throughout the several views, and wherein:

FIG. 1 is a perspective view of a user carrying a collapsible chair constructed in accordance with the principles of the present invention;

FIG. 2 is a side elevational view of the collapsible chair illustrated in FIG. 1;

FIG. 3 is a fragmentary, exploded, perspective view of the underside of the seat of the collapsible chair illustrated in FIGS. 1 and 2 of the drawing; and FIG. 4 is a fragmentary, exploded, perspective view of a lower portion of the chair illustrated in FIGS. 1 and 2 of the drawing.

DESCRIPTION OF THE PREFERRED EMBODIMENT

Referring now to the drawing and, in particular, to FIGS. 1 and 2 wherein there is illustrated one example of the present invention in the form of a collapsible chair 10. The chair 10 comprises a seat 12, a support base 14, and a leg 16 which functions to connect the seat 12 to the base 14, all of which will be described in greater detail hereinafter.

The seat 12 comprises an interior frame 18 onto which is fastened a support plate 20 by any suitable means, such as screws 22 (FIG. 3), extending through the support plate 20 and into threaded engagement with the frame 18. A suitable support material, such as a sponge rubber 24 or the like, is positioned on top of the frame 18 and attached thereto by any suitable means, such as an adhesive, disposed between the interface of the upper surface of the support frame 18 and the bottom surface of the sponge rubber 24. A protective cover 26 preferably of a waterproof material, such as nylon or other comparable materials, covers the exposed surfaces of the foam rubber 24 and the frame 18 and is secured thereto by any suitable means (not shown). A strap harness 28 (FIGS. 1 and 2) has its opposite ends securely attached to the other side of the seat frame 18 by any suitable means, such as fasteners 30. The harness 28 may include a buckle and apertured end arrangement 31 (FIG. 1) of the conventional type to permit adjustment of the length of the harness 28. This facilitates the carrying of the chair 10 by a user 33 in the manner illustrated in FIG. 1, as will be explained in greater detail hereinafter. When the chair 10 is not being carried, the harness 28 may be folded and secured to the bottom of the seat frame 18 by means of a strap 32 which has one end that snap-lockingly engages a suitable fastening means 35. The harness 28, when folded into a looped form, can be retained by the folded strap 32 in a secured, out-of-the-way arrangement.

The seat 12 further comprises a T-shaped flange 34 (FIG. 3) which has its base 36 fastened to the support plate 20 by threaded fasteners 38 that extend through the base 36 and into threaded engagement with the support plate 20. The leg 40 of the T-shaped flange 34 has a central through bore 42 and a plurality of diametrically opposed pairs of bores 44 and 46, for the purpose of which will be described hereinafter. The bores 44 and 46 are arcuately spaced at 90° intervals.

Referring now to FIGS. 2, 3, and 4 wherein it may be seen that the leg 16 comprises an upper leg member 50 and a lower leg member 52. The lower end of the upper leg member 50 defines an externally threaded post 54 which is received within a longitudinally threaded bore 56 in the upper end of the lower leg member 52 whereby the upper leg member 50 is telescopically received by the lower leg member 52, and up-and-down movement of the two members with respect to one another may be obtained by rotating the upper leg member 50 with respect to the lower leg member 52. The upper leg member 50 includes a plate portion 58 having a central aperture 60 and a pair of diametrically spaced stop pins 62 that extend outwardly from the face of the plate portion 58. It can be seen that when the plate portion 58 is in abutment with the side of the flange 40 and the apertures 60 and 42 are aligned, the stop pins 62 may be selectively positioned into the pairs of bores 44 or 46. When it is desired to have the chair 10 opened in a usable position, the stop pins 62 are received within the bores 44, as shown in FIG. 2. A suitable fastening member, such as bolt 64 and washer and wing nut arrangement 66, may be used to securely fasten the leg 16 to the flange 40. When it is desired to collapse the chair 10, the bolt 64 is removed from the apertures 60 and 42; and the seat is rotated 90° with respect to the upper leg member 50; and the stop pins 62 are received within the diametrically opposed bores 46. The wing nut 66 is then attached to the bolt 64, and the leg 16 is thereby secured to the seat in the position illustrated in FIG. 1; that is, in a collapsed position.

The lower leg portion 52 has a plate 70 formed on its lower end and includes a central aperture 72 and a pair of diametrically opposed bores 74. The plate 70 further comprises a pair of diametrically opposed notches 76 which are arcuately spaced 90° from bores 74. The purpose of the notches 76, the bores 74, and the central aperture 72 will all be described in greater detail hereinafter, after the description of the support base 14.

As can best be seen in FIGS. 2 and 4, the support base 14 comprises a disk-shaped member 80 which is flattened along its bottom edge 82 to provide suitable support for the chair 10 when it is in the upright position illustrated in FIG. 2. The disk-shaped member 80 is also flattened at its top wall 84 so as to receive a second T-shaped flange 86. The base 88 of the T-shaped flange 86 is secured to the disk member 80 by means of bolts 89 that extend through both the base 88 and the disk wall 84 into threaded engagement with conventional nuts 90 (FIG. 2). The leg 92 of the flange 86 has a central aperture 94 and a pair of diametrically opposed and outwardly extending stop pins 96. It can be seen, upon inspection of FIGS. 2 and 4, that when the apertures 94 of the flange 86 and the aperture 72 formed in the plate portion 70 of the leg member 52 are brought in axial alignment to permit the passage of a bolt 98 therethrough, the bores 74 will be axially aligned with and will receive the stop pins 96. The engagement of a wing nut 100 with the bolt 98 secures the lower leg 52 with the flange 86 whereby the chair 10 is in the upright position or usable position illustrated in FIG. 2 of the drawing.

It can also be seen that when the bolt 98 is removed from the aligned apertures 72 and 94 and the flange 86 and the lower leg portion 52 are rotated 90° with respect to each other, the stop pins 96 become aligned with the notches 76 and are received therein when the bolt 98 is inserted through the aligned apertures 72 and 94 and the wing nut 100 engages the same in the conventional manner. In this position the base 14 is folded against the lower leg 52 in the manner illustrated in FIG. 1 of the drawing.

It can thus be seen that applicant has disclosed a portable seat which can be easily carried by the user and wherein the seat may be simply collapsed from the usable or seating position illustrated in FIG. 2 to the collapsed, carrying position illustrated in FIG. 1.

It can also be seen that because of the threaded engagement between the upper and lower members of the leg 16, the height of the chair 10 may be easily adjusted up and down such as to the position 102 illustrated by the phantom line in FIG. 2.

It is particularly envisioned that the present invention will be utilized by hunters. Since the chair 10 has a wide base 14, a hunter may sit on the chair 10 and easily balance himself; and because of the relative rotation permitted between the upper and lower legs of the chair 10, the hunter may simply rotate around in a 360° fashion with the least amount of effort by the hunter and, thus, with the least amount of noise so as not to scare off any game that may be thereby. At the same time, the hunter may easily and properly position himself with respect to the hunted animal and fire upon the same.

It should be understood by those skilled in the art of collapsible chairs that other forms of applicant's invention may be had, all coming within the spirit of the invention and scope of the appended claims.

What is claimed is as follows:

1. A collapsible chair adapted to be carried by a user, said chair comprising:

a disk-shaped base for supporting said chair in an upright position, said base having an upright flange with a pair of laterally spaced, outwardly projecting, non-movable stop pins;

a leg having first and second members telescopically attached for relative rotational movement, said first member having first and second laterally spaced bores disposed at 90° intervals for selectively and laterally receiving said stop pins to permit said disk-shaped base to be locked in a first position wherein said leg is disposed along an axis perpendicular to said base and a second position wherein said leg is inclined at 90° with respect to said first position;

a first threaded fastener extending through said leg and said base flange;

a nut engaged by said fastener to secure said leg to said base in either of said positions;

said second member having a second pair of laterally spaced and outwardly projecting, non-movable stop pins;

a seat having a downwardly projecting flange with first and second laterally spaced bores disposed at 90° intervals for selectively and laterally receiving said second stop pin to permit said seat to be locked in a first position wherein said seat is disposed in a plane perpendicular to said leg and a second position wherein said seat is inclined at 90° with respect to said seat first position;

a second threaded fastener extending through said leg and said seat flange;

a second nut engaged by said second fastener to secure said leg to said seat in either of said seat positions; and strap means connected to said seat to facilitate the carrying of said chair when the same is in its collapsed position.

* * * * *